US007102573B2

(12) United States Patent
Morrow et al.

(10) Patent No.: US 7,102,573 B2
(45) Date of Patent: Sep. 5, 2006

(54) PATCH ANTENNA

(75) Inventors: Jarrett Morrow, Bow, NH (US); Adam M. Alevy, Carlisle, MA (US)

(73) Assignee: Cushcraft Corporation, Manchester, NH (US)

( * ) Notice: Subject to any disclaimer, the term of this patent is extended or adjusted under 35 U.S.C. 154(b) by 35 days.

(21) Appl. No.: 10/756,006

(22) Filed: Jan. 13, 2004

(65) Prior Publication Data

US 2004/0140936 A1 Jul. 22, 2004

Related U.S. Application Data

(60) Provisional application No. 60/439,742, filed on Jan. 13, 2003.

(51) Int. Cl.
*H01Q 1/38* (2006.01)

(52) U.S. Cl. ..... 343/700 MS

(58) Field of Classification Search ..... 343/700 MS, 343/743, 702

See application file for complete search history.

(56) References Cited

U.S. PATENT DOCUMENTS 4,367,474 A * 1/1983 Schaubert et al. ... 343/700 MS
5,861,848 A * 1/1999 Iwasaki ..... 343/700 MS
6,501,427 B1 * 12/2002 Lilly et al. ..... 343/700 MS
6,567,048 B1 * 5/2003 McKinzie et al. ... 343/700 MS
6,646,605 B1 * 11/2003 McKinzie et al. ... 343/700 MS
6,646,607 B1 * 11/2003 Usui et al. ..... 343/700 MS
6,714,162 B1 * 3/2004 Kadambi et al. .... 343/700 MS
6,741,214 B1 * 5/2004 Kadambi et al. .... 343/700 MS
6,795,023 B1 * 9/2004 Chen ..... 343/700 MS

OTHER PUBLICATIONS

Quarter-wave patch antenna with 35% bandwidth, by Veli Voipio, Jani Ollikainen and Pertti Vainikainen, 1998.
Effect of Groundplane Size on Radiation Efficiency and Bandwidth of Dual-Band U-PIFA, by Pekka Salonen, 2003.
Bandwidth Enhancement Technique for Quarter-Wave Patch Antennas, by Chi Yuk Chiu, 2003.
Simulation of Bandwidth Enhancement on the Quarter-Wave Shorted Patch by Adding a Shorting Pin, by R. Chair, K.M. Luk and K.F. Lee, 2001.
Microstrip Patch Antenna for GSM 1800 Handsets, by Jacinto Barreiros, Pedro Cameirao, Custodio Peixeiro, 1999. A Capacitively Loaded PIFA for Compact Mobile Telephone Handsets, by Corbett R. Rowell, 1997.

* cited by examiner

*Primary Examiner*—Hoang V. Nguyen
*Assistant Examiner*—Huedung X. Cao
(74) *Attorney, Agent, or Firm*—Hayes Soloway PC

(57) ABSTRACT

A device and method for patch antenna with enhanced feed is provided. Generally, the patch antenna comprising: a ground plate, a patch plate parallel to the ground plate, a shorting wall, and a feed line. The shorting wall connects an edge of the ground plate to an edge of the patch plate. The feed line passes through an aperture in the ground plate and connects to two locations on the patch plate.

19 Claims, 8 Drawing Sheets

PATCH ANTENNA

CROSS-REFERENCE TO RELATED APPLICATION

This application claims priority to U.S. Provisional Application entitled, "Miniature Microstrip Patch Antenna with a Bandwidth-Enhancing Feed Structure," having Ser. No. 60/439,742, filed Jan. 13, 2003, which is entirely incorporated herein by reference.

FIELD OF THE INVENTION

The present invention is generally related to microstrip patch antenna, and more particularly is related to a microstrip patch antenna with enhancing feed structure.

BACKGROUND OF THE INVENTION

Antennas function to receive and transmit free-space electromagnetic waves. When an antenna is receiving, the antenna transforms free-space propagating waves by inducing a guided electromagnetic wave within the antenna. The guided electromagnetic wave is then fed into an integrated circuit. The integrated circuit then deciphers the signal being transmitted. When an antenna is transmitting, the antenna receives the guided electromagnetic wave for transmission from a feed line and induces an electric field surrounding the antenna to form a free-space propagating electromagnetic wave.

An important consideration in the selection and design of the antenna is the propagation pattern of the free-space propagating electromagnetic wave. In a typical application, a transmitting antenna needs to be able to transmit a guided electromagnetic wave to and from another antenna located on a device such as a base station, hub, or satellite. The base station can be located in any number of directions from the transmitting antenna. Consequently, it is essential that the antennas for such wireless communication devices have an electromagnetic propagation pattern that radiates in all directions.

Another important factor to be considered in designing antennas for wireless communication devices is bandwidth of the antennas. Wireless communication devices such as cellular phones and personal data assistants (PDAs) operate over a frequency band of approximately 1.85–1.99 Gigahertz, thus requiring a useful bandwidth of 7.29 percent. Antennas need to operate at the specific bandwidth of the wireless device. Accordingly, antennas for use on these types of wireless communication devices are be designed to meet the appropriate bandwidth requirements, otherwise communication signals will be severely attenuated.

The demand for compact and inexpensive antennas has increased as wireless communication has become commonplace in a variety of applications. Personal wireless communication devices, for example, cellular phones and PDA have created an increased demand for compact antennas. The increase in satellite communication has also increased the demand for antennas that are compact and provide reliable transmission. In addition, the expansion of wireless local area networks at home and work has also necessitated the demand for antennas that are compact and inexpensive.

A microstrip patch antenna is a type of antenna that offers a low profile, i.e. thin, and easy manufacturability, which provides a great advantage over traditional antennas. FIG. 1 shows a perspective view of a general shorted-wall, quarter-wave microstrip patch antenna 100. The patch antenna 100 comprises a grounding plate 102, a patch plate 104, and a shorting wall 106. A coaxial cable 108 supplies the guided electromagnetic wave that will be transmitted. Typically the coaxial cable 108 is a 50-ohm cable comprising a signal wire and a ground wire. The signal wire carries the guided electromagnetic wave. The ground wire connects to the ground plate 102 of the microstrip patch antenna 100. The signal wire or feed line 110 passes through an aperture 114 in the ground plate 102 and connects at a location on the patch plate 104. The free-space electromagnetic wave is induced by the patch plate 104 causing a free-space electromagnetic wave to propagate from the patch plate 104.

A properly designed antenna should have a reactive impedance component equal to zero and have a real impedance component equal to a load impedance of the antenna. Additional techniques that allow an antenna designer to manipulate the real impedance of the antenna can provide better designs for patch antennas. Thus, a heretofore unaddressed need exists in the industry to address the aforementioned deficiencies and inadequacies.

SUMMARY OF THE INVENTION

Embodiments of the present invention provide a device and a method for a microstrip patch antenna with an enhanced feed structure. Briefly described, in architecture, one embodiment of the patch antenna, among others, can be implemented as follows. The patch antenna comprises a ground plate, a patch plate parallel to the ground plate, a shorting wall, and a feed line. The shorting wall connects an edge of the ground plate to an edge of the patch plate. The feed line passes through an aperture in the ground plate and connects to two locations on the patch plate.

Embodiments may include one or more of the following. The patch plate, shorting wall, and ground plate can be made of the same metallic material. A dielectric material comprising a lightweight foam material having a high dielectric constant can also be sandwiched between the ground plate and patch plate. In addition, the embodiment may include a coaxial cable with a ground wire and a signal wire wherein the signal wire connects to the feed line and the ground wire connects to the ground plate.

In another aspect, the feed line of the patch antenna can be made by bending two or more tab portions of the patch plate toward the ground plate. In this aspect, the feed line connects to the ends of the two or more tab portions. In yet another aspect, the shorting wall and the patch plate can be made by bending the ground plate to about ninety degrees at a first location and bending the ground plate to about another ninety degrees at a second location. In this aspect, the shorting wall comprises a first portion located between the first location and the second location and the patch plate comprises a second portion located after the second location.

The following steps can broadly summarize a method of one embodiment. A feed signal is supplied through a feed line. The feed signal is distributed to the two locations on a patch plate. The patch plate is grounded with a shorting wall connecting the patch plate to a grounding plate and an electromagnetic wave is propagated from the patch plate.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
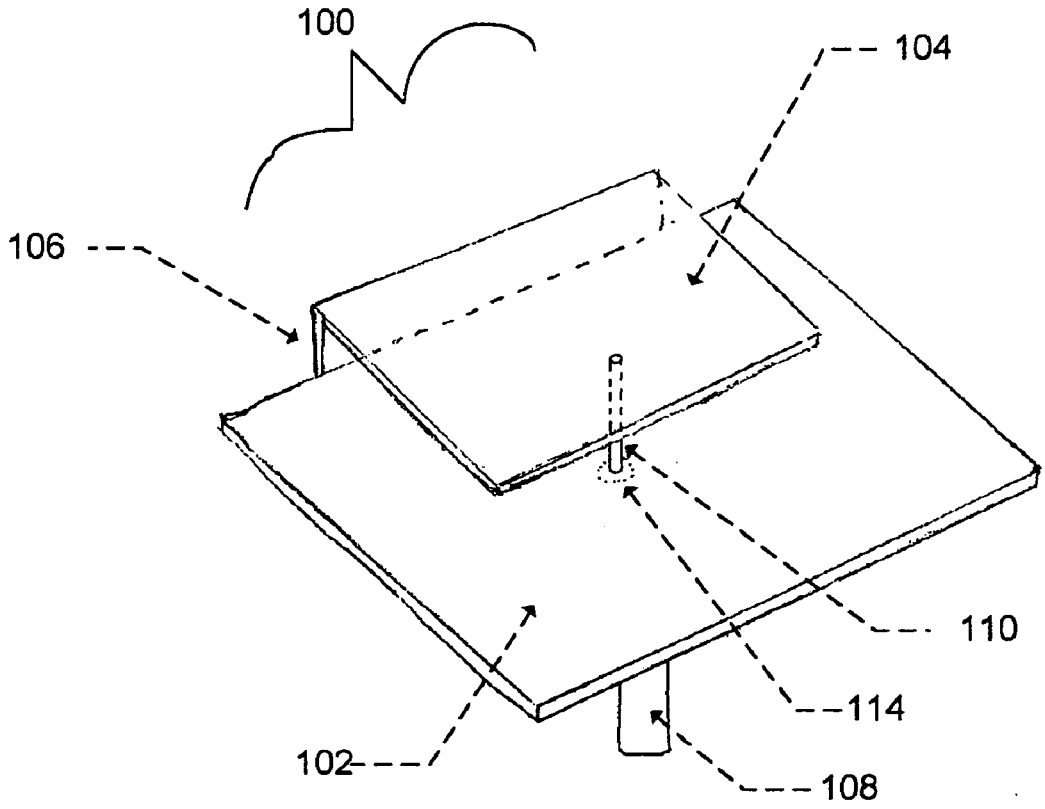
FIG. 1 Prior Art
FIG. 1 is a schematic diagram providing a perspective view of a prior art microstrip patch antenna.
Figure 2:
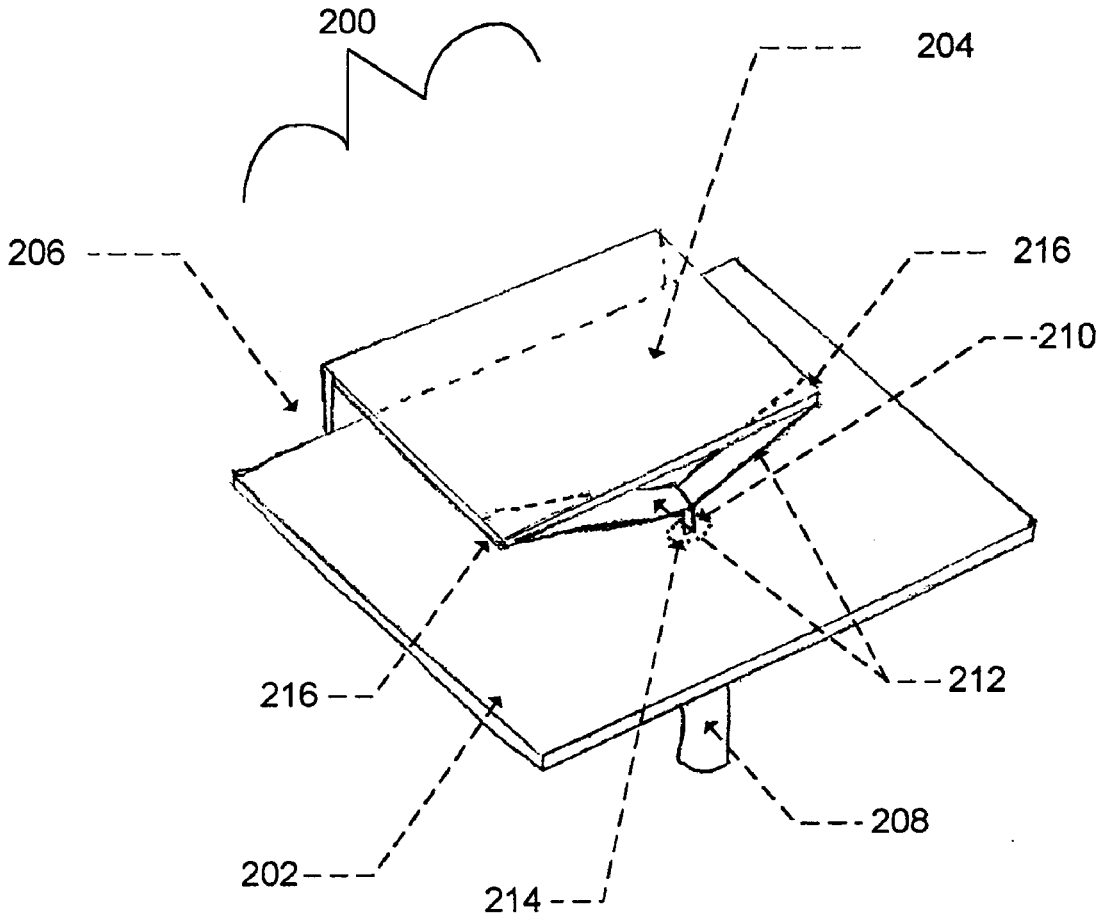
FIG. 2 is a schematic diagram providing a perspective view of the patch antenna with enhanced feed structure.

A patch antenna having a bandwidth-enhancing feed 200, in accordance with a first exemplary embodiment of the invention, is shown in FIG. 2. The same embodied patch antenna with enhanced feed 200 is illustrated from a side view in FIG. 3 and from a front view in FIG. 4. The patch antenna with enhanced feed 200 provides flexibility in the design of the antenna, so that the inductance of the antenna may be decreased allowing greater bandwidth of the antenna. For example, using the second exemplary embodiment as discussed in detail below, a 2:1 Voltage Standing Wave Ratio (VSWR) with a bandwidth of 28% of the antenna may be achieved.

The patch antenna with enhanced feed 200 comprises a grounding plate 202, a patch plate 204, and a shorting wall 206. A coaxial cable 208 supplies a guided electromagnetic wave that will be transmitted by the antenna. In this embodiment a coaxial cable 208 comprises a signal wire and a ground wire (not shown). It should be noted that the coaxial cable 208 may be a 50-ohm coaxial cable or other cable. The ground wire connects to the ground plate 202 of the patch antenna with enhanced feed 200. The signal wire that carriers the guided electromagnetic wave, herein referred as a feed line 210 passes through an aperture 214 in the ground plate and connects to the bottom of the feed plate 204. The feed line 210 passes through the aperture 214 and is electrically insulated from the ground plate 202. The feed plate 212 receives the guided electromagnetic wave from the feed line 210 and transfers it to two periphery edges 216 on the patch plate 204. Currents produced in the patch plate 204 by the guided electromagnetic wave agitate the electric field surrounding the patch plate 204. The pattern of agitation of the surrounding electric field forms a free-space electromagnetic wave. The free-space electromagnetic wave radiates outward from the patch plate 204.

Figure 3:
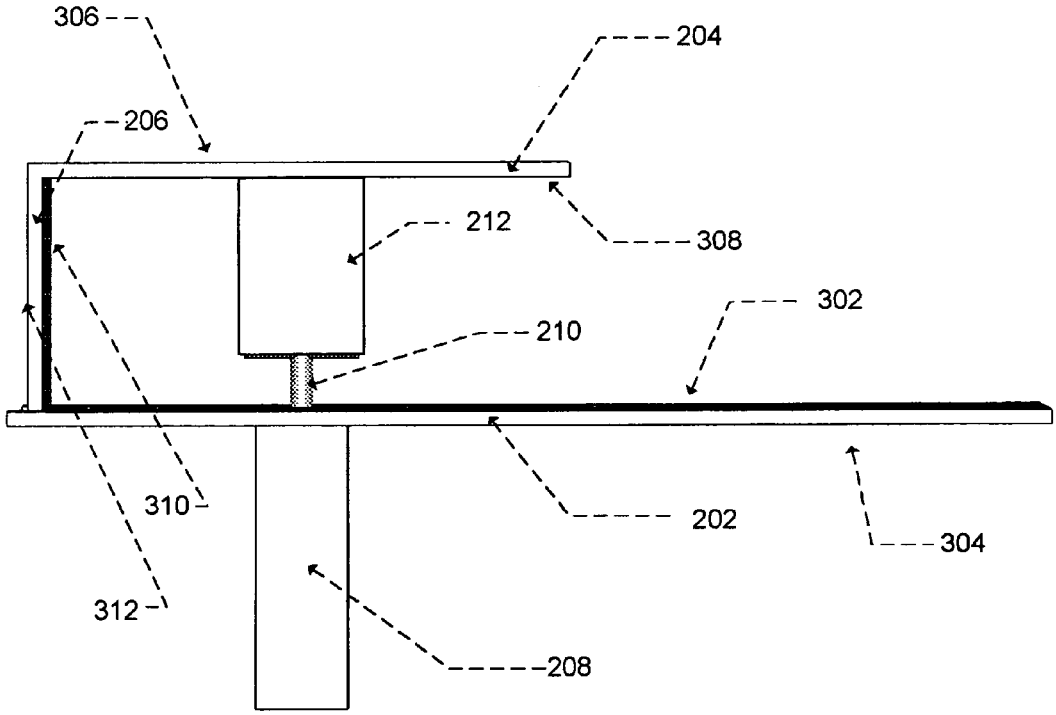
FIG. 3 is a schematic diagram providing a side view of the patch antenna with enhanced feed structure of FIG. 2.
Figure 4:
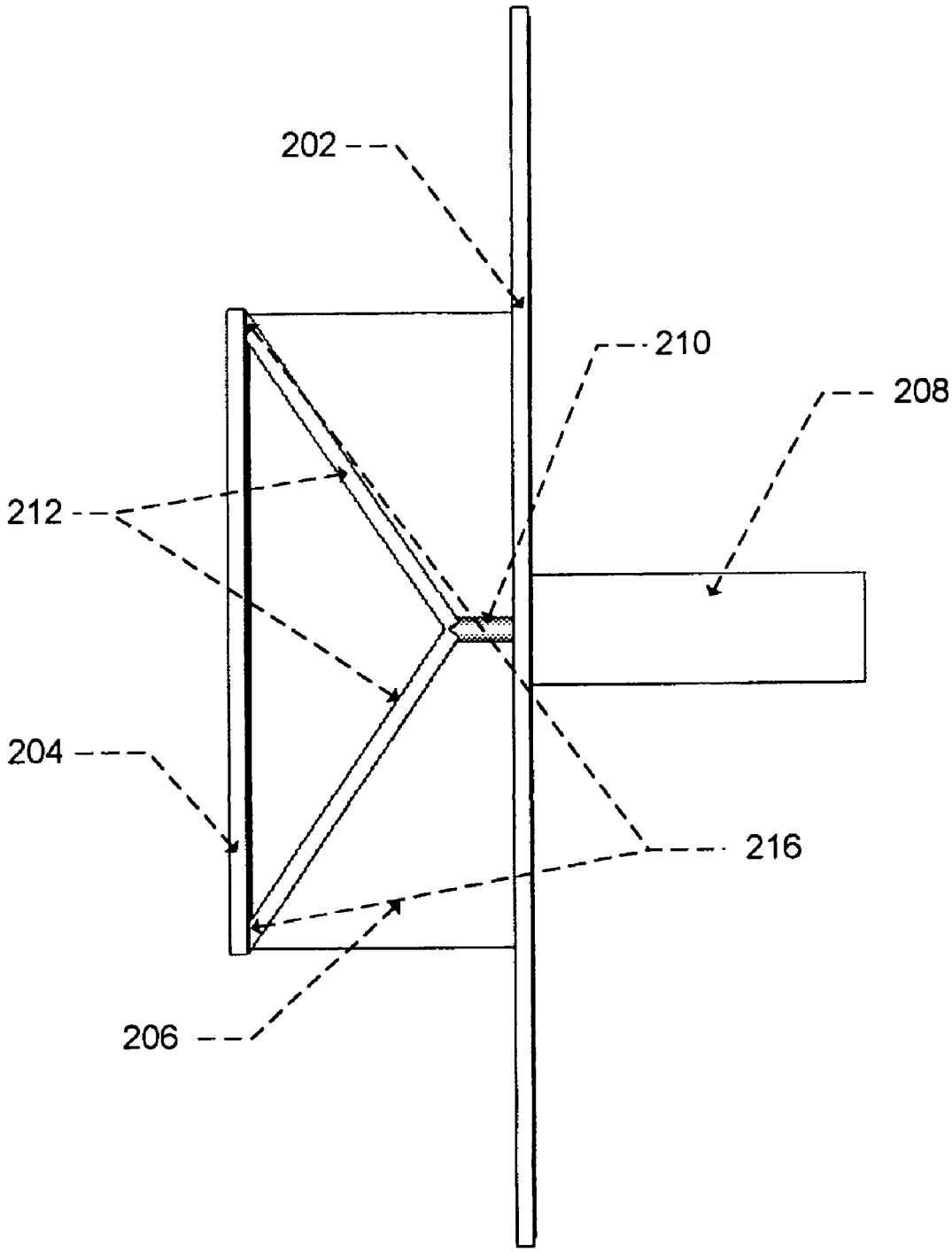
FIG. 4 is a schematic diagram providing a front view of the patch antenna with enhanced feed structure of FIG. 2.

FIG. 3 depicts a side view of the patch antenna with enhanced feed structure 200. The different surfaces of the ground plate 202, patch plate, 204 and shorting wall 206 are displayed in FIG. 3. The ground plate 202 has a top surface 302 and a bottom surface 304. Similarly, the patch plate 204 also has a top surface 306 and a bottom surface 308. The top surface of the ground plate 302 is located opposite the bottom surface of the patch plate 308. The shorting wall 206 provides an electrical connection from the patch plate 204 to the ground plate 202. The shorting wall 206 comprises a front surface 310 and a back surface 312. The back surface 312 of the shorting wall 312 faces toward an outside surface of the patch antenna with enhanced feed 200. Both the back surface 312 and front surface 310 of the shorting wall 206 run perpendicular to the ground plate 202 and patch plate 204. It should be noted that the shorting wall 206 does not have to be exactly perpendicular to the ground plate 202 and patch plate 204. Similar ground plate 202 and patch plate 204 do not have to be exactly parallel.

In accordance with the first and second embodiments, the dimensions of the ground plate 202 are about 0.9 inches wide by about 0.9 inches long; however, a 20 percent variance is possible from these dimensions. The dimensions of the patch plate 204 are about 0.470 inches long by about 0.475 inches wide and the thickness of the patch plate 204 is about 0.012 inches. The height of the shorting wall 206, i.e. distance between the ground plate 202 and the patch plate 204 (sometimes referred to as the patch height), is about 0.2 inches. This is a relatively large patch height equating to approximately 0.1 wavelengths. It should be noted that other dimensions width, length, and height may be utilized in the design of the patch antenna with enhanced feed 200.

The large patch height provides a large impedance bandwidth. In addition to a large patch height, the use of air between the patch plate 204 and ground plate 202, instead of a dielectric material as discussed later, is another source for producing large impedance bandwidths. The impedance for a patch antenna without the enhanced feed and with these dimensions over the frequency bandwidth of 4.0 to 7.0 Gigahertz would present an unacceptably large inductive component. However, by connecting the signal feed 210 to two periphery edges 216 of the patch plate 204 through the feed plate 212, the inductive component can be reduced to about half the value of a prior art patch antenna having same dimensions. Connecting the signal feed at two locations on the patch plate 204 acts as two impedances in parallel. The result is that half of the impedance is seen by the guided electromagnetic wave.

In accordance with the first and second embodiments, the patch antenna with enhanced feed 200 and 500, air is used as a dielectric material between the patch plate 204 and the ground plate 202. However, a wide variety of materials with a dielectric constant in the range of about one to ten can be sandwiched between the patch plate 204 and ground plate 202. For example, a Duroid® material, which is a Teflon® based material, can be used in place of air. The dielectric constant primarily affects the bandwidth and radiation efficiency of the antenna, with lower permittivity giving wider impedance bandwidth and reduced surface wave excitation.

The patch antenna with enhanced feed 200 can be constructed in a variety of ways. The ground plate 202, patch plate 204, and shorting wall 206 can be made of the same metallic material or each can be made of different metallic materials. One method of constructing the patch antenna with enhanced feed 200 is to solder the individual components together. The shorting wall 206 is soldered to edges of the ground plate 202 and patch plate 204. The feed plate 212 is shaped into a "V" shape and the two top edges of the "V" are soldered to the bottom surface 308 of the patch plate 204. An aperture 214 is made through the ground plate 202 in a location under the feed plate 212. The coaxial cable 208 connects to the bottom 304 of the ground plate 202. The feed line 210 passes through the aperture 214 and connects to the bottom vertex of the feed plate 212. In accordance with the first and second embodiments, feed plate 212 is in the shape of a "V". However, a variety of shapes could be used, for example but not limited to, a "U" shape or a semicircle shape. In addition, the feed plate 212 can be an extension of the feed line 210. In this embodiment (not shown), the feed line 210 splits into a "Y" and connects at two locations on the patch plate 204 eliminating the need for the feed plate 212.

Figure 5:
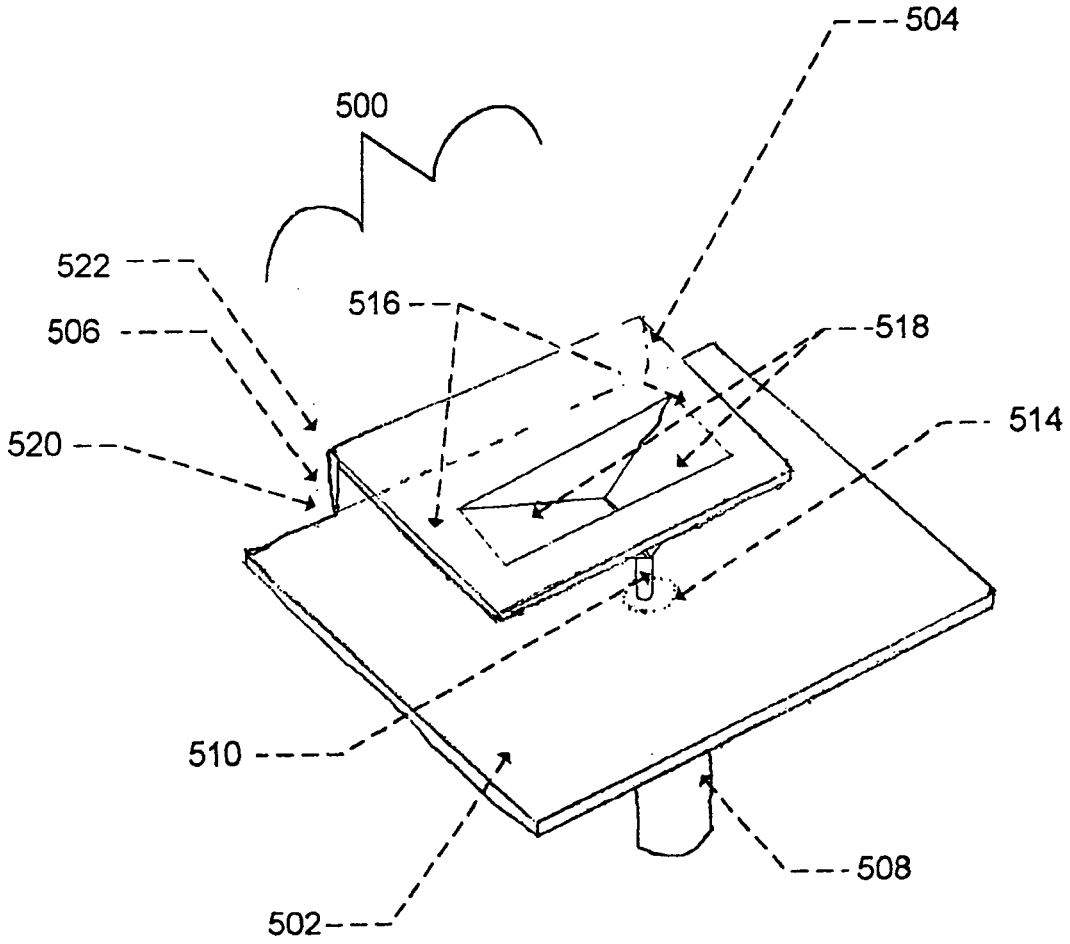
FIG. 5 is a schematic diagram providing a perspective view in accordance with a second exemplary embodiment of the invention of a patch antenna with enhanced feed structure.

FIG. 5 is a schematic diagram providing a perspective view in accordance with a second exemplary embodiment of the invention of a patch antenna with enhanced feed structure. In accordance with the second exemplary embodiment shown in FIG. 5, the patch antenna with enhanced feed 500 is constructed using a method different from that used to construct the antenna with enhanced feed 200 of the first embodiment. In addition, the components of the patch antenna with enhanced feed 500 are made from the same sheet of metallic material. The aperture 514 is punched out from the ground plate 502.

The shorting wall 506 and the patch plate 504 are made by bending the sheet of material to about ninety degrees at a first location 520 and bending the sheet to about another ninety degrees at a second location 522. The shorting wall 506 comprises a first portion located between the first location 520 and the second location 522. The shorting wall 506 is generally perpendicular to the ground plate 502 and patch plate 504. The ground plate 502 comprises the section before the first location 520 and the patch plate 504 comprises the section after the second location 522.

The feed plate is composed of two tabs 518 punched from the patch plate 504. The two tabs 518 are bent at the periphery edges 516 downwards toward the ground plate 502. The coaxial cable 508 connects to the bottom of the ground plate 502. The feed line 510 passes through the aperture 514 and connects to the two edges of the tabs 518. In another embodiment (not shown), the feed plate can also be formed by not cutting the tabs 518 apart from each other and stamping or pressing the tabs 518 downward towards the ground plate 502 in semicircle shape.

While in the second exemplary embodiment the patch antenna with enhanced feed 500 is constructed by bending a sheet of material in two locations, a variety of methods can be used. For example but not limited to, bending the sheet of material into a "U" shape, wherein the shorting wall would have a rounded profile, the right-hand portion of the "U" shape round plate would form the ground plate, and the left-hand portion of the "U" shape form the patch plate.

Figure 6:
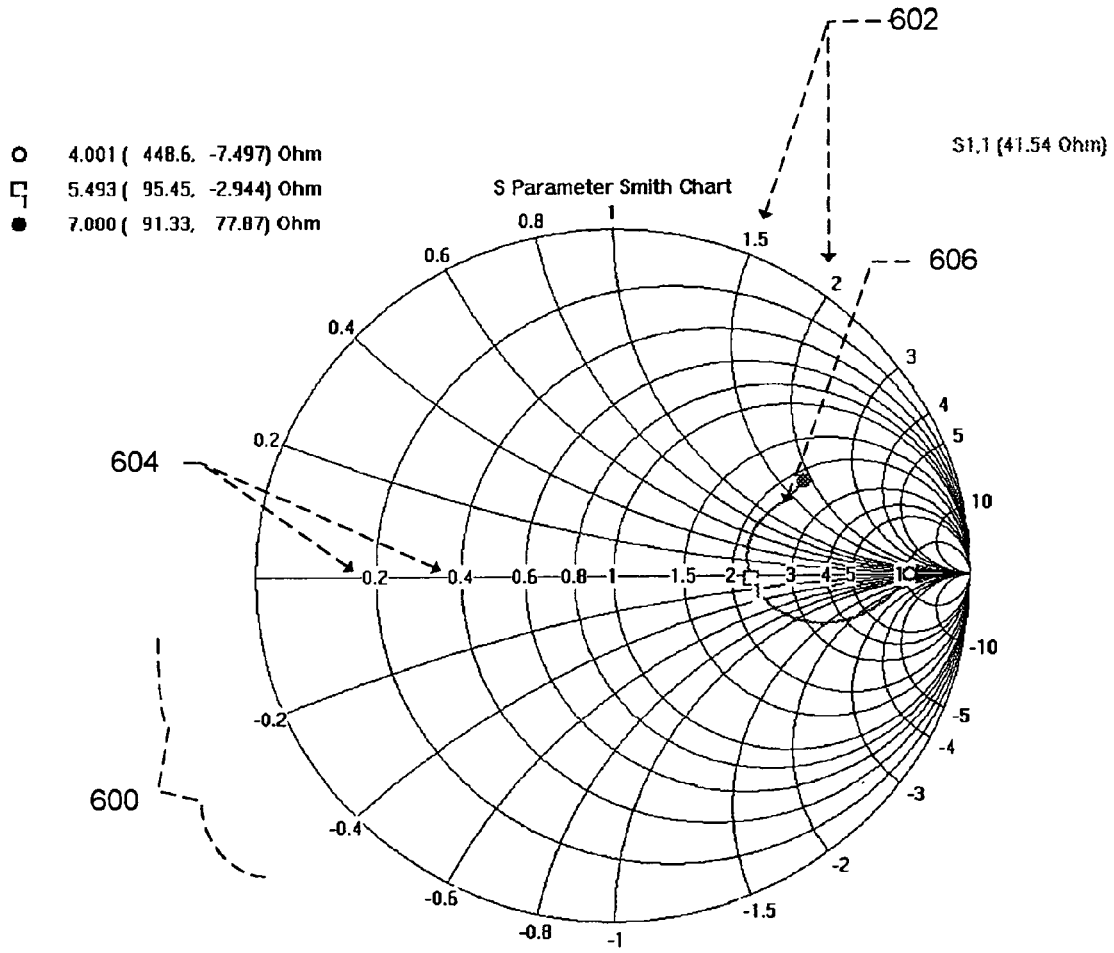
FIG. 6 is a Smith chart of the second exemplary embodiment of the patch antenna with enhanced feed structure with an input impedance from 4 gigahertz (GHz) to 7.0 GHz.

FIG. 6 shows an impedance plot 600 produced the by patch plate with enhanced feed 500 over a frequency bandwidth of 4.0 to 7.0 Gigahertz. The impedance plot 600 was produced by the patch antenna with enhanced feed 500 in accordance with the second embodiment with the above described dimensions. The impedance plot 600 is shown using a Smith chart. As is known by those having ordinary skill in the art, a Smith chart is used in the design of antennas to match input impedance with the load impedance of the antenna. In the Smith chart imaginary components of load impedances 602 are listed around the perimeter of the chart. In addition, points of constant resistance form circles on the complex reflection-coefficient plane. These circles on the Smith chart are shown for various load resistances 604. The impedance 606 demonstrates a very good impedance match at the center of the band and a better than 1.5:1 Voltage Standing Wave Ratio (VSWR) with a bandwidth of 14.5 percent.

Figure 7:
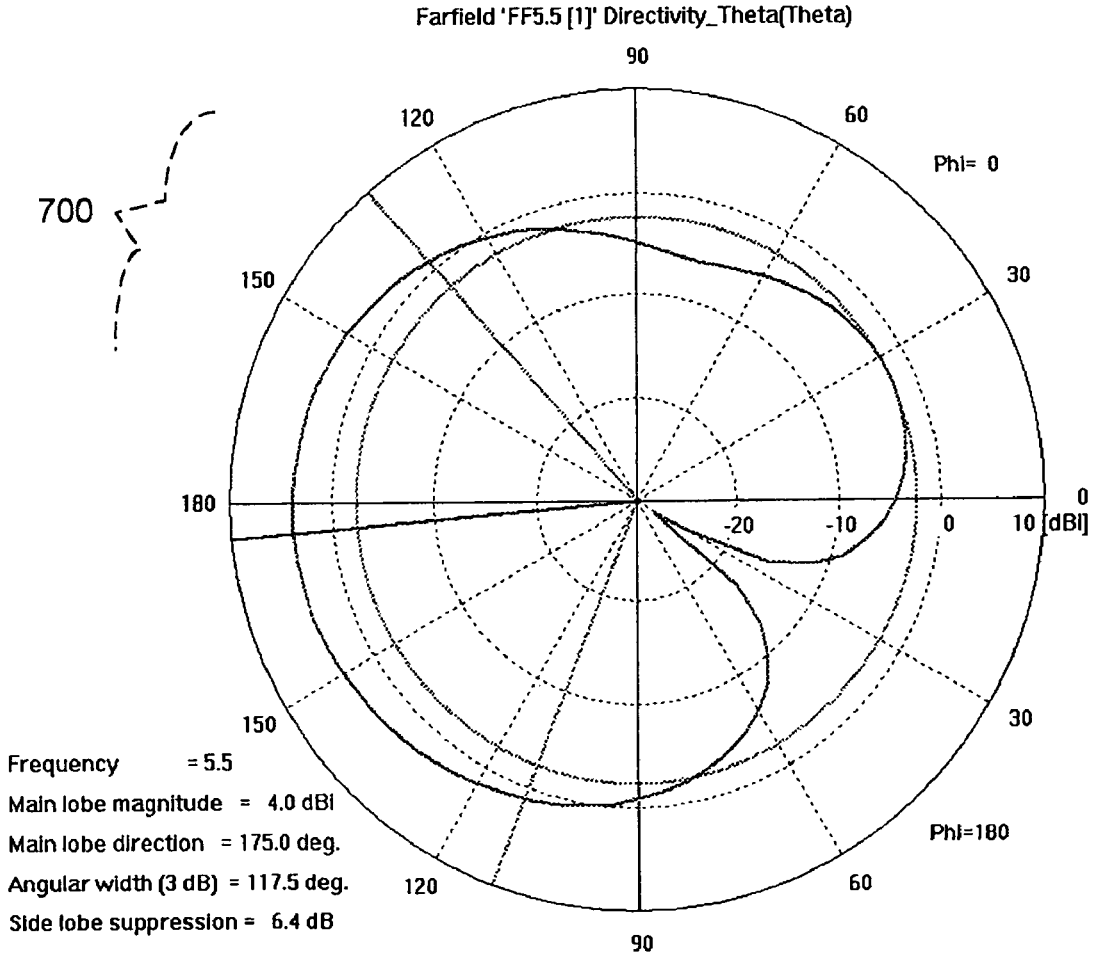
FIG. 7 is an E-plane radiation pattern of the second exemplary embodiment of the patch antenna with enhanced feed structure at 5.5 Ghz.
Figure 8:
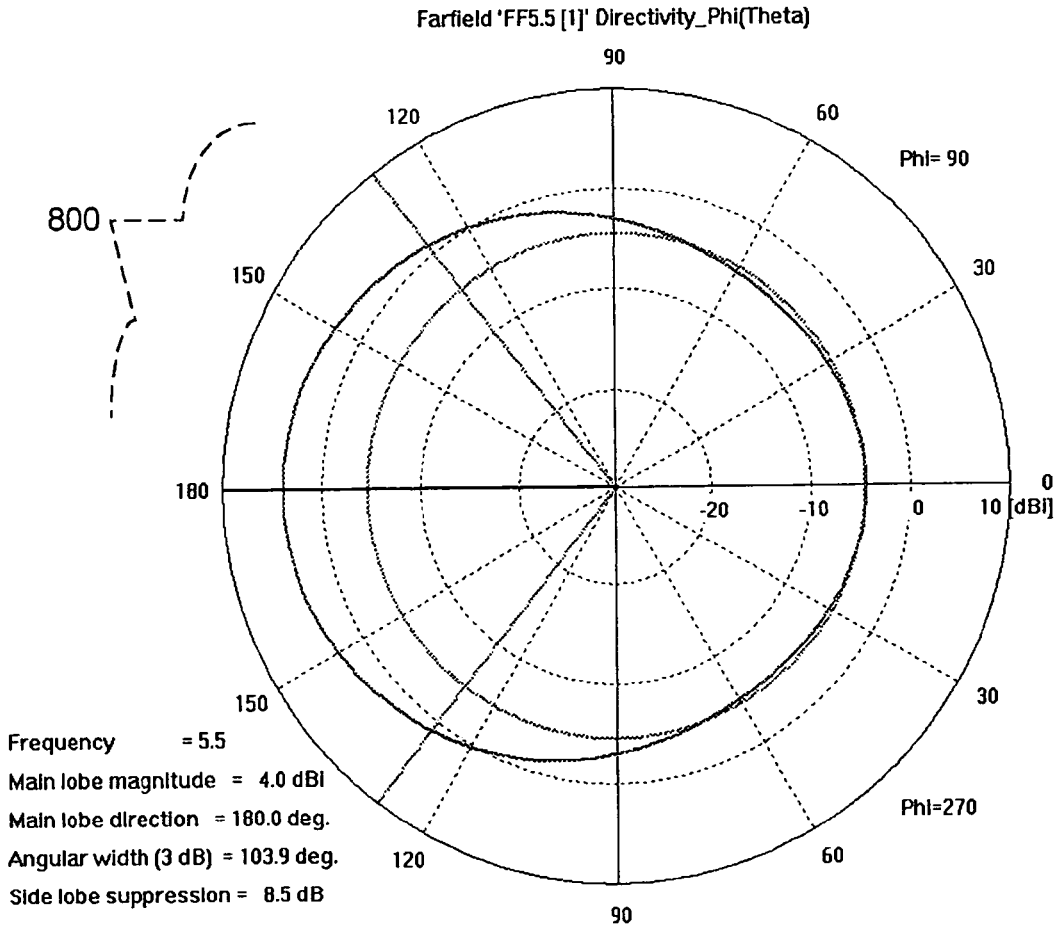
FIG. 8 is an H-plane radiation pattern of the second exemplary embodiment of the patch antenna with enhanced feed structure at 5.5 Ghz.

FIG. 7 shows the E-plane co-polarized patterns 700 produced above the patch plate 504 at a frequency of 5.5 Gigahertz. FIG. 8 shows the H-plane 800 patterns produced above the patch plate 504 at a frequency of 5.5 Gigahertz. The E-plane 700 and H-plane 800 were produced by the patch antenna with enhanced feed 500 with the above described dimensions. The E-plane and H-plane produced by a typical patch antenna are similar to the pattern shown in FIG. 7 and FIG. 8 for the bandwidth of frequencies ranging from about 5.15 to about 5.85 Gigahertz. The patch antenna with enhanced feed provides a gain of approximately 4 dBi. This gain and the patterns discussed above are typical of a microstrip patch antenna on a small ground plane. The resulting effect provides an additional tool to lower impedance without drastically altering the gains seen by the patch antenna.

In the embodiments discussed above, the patch antennas with enhanced feed 200 and 500 both have a square shaped patch plate. However, patch plates for patch antennas can be implemented in a variety of shapes, for example but not limited to, circles and rectangles. It will be apparent that an antenna designer can implement the feed structure of the patch antenna with enhanced feed with a variety of patch plate shapes.

In addition to the embodiments discussed above, the feed structures of the patch antenna with enhanced feed 200 and 500 are designed with guided electromagnetic wave feeds at two locations on the patch plate 204 and 504. It will be apparent that an antenna designer can implement the feed structures with a guided electromagnetic wave feed at more than two locations on the field plate 204 and 504. By connecting the guided electromagnetic wave feed at three locations on the patch, the resulting guided electromagnetic wave feed would act as three impedances in parallel, thus reducing impedance seen by the guided electromagnetic wave.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A patch antenna, comprising:

a ground plate having an aperture;

a patch plate, having a periphery, at least substantially parallel to the ground plate;

a shorting wall wherein the shorting wall connects an edge of the ground plate to an edge of the patch plate; and a feed line wherein the feed line passes through the aperture in the ground plate and connects substantially to the periphery of the patch plate.

2. The patch antenna of claim 1, wherein the patch plate, shorting wall, and ground plate are made of the same metallic material.

3. The patch antenna of claim 1, wherein a dielectric material comprising a lightweight foam material having a high dielectric constant is located between the ground plate and the patch plate.

4. The patch antenna of claim 1, wherein two or more tab portions of the patch plate are bent toward the ground plate, and wherein the feed line passes through the aperture in the ground plate and connects to the ends of the two or more tab portions whereby the two or more tab portions are the at least two locations on the patch plate.

5. The patch antenna of claim 1, further comprising a coaxial cable having a ground wire and a signal wire wherein the signal wire connects to the feed line and the ground wire connects to the ground plate.

6. The patch antenna of claim 1, wherein the shorting wall and the patch plate are made by bending the ground plate to about ninety degrees at a first location and bending the ground plate to about another ninety degrees at a second location wherein the shorting wall comprises a first portion located between the first location and the second location and the patch plate comprises a second portion located after the second location.

7. The patch antenna of claim 1, wherein the feed line is connected to at least two opposite periphery edges.

8. A patch antenna, comprising:

means for grounding;

means for transmitting parallel to the means for grounding;

means for shorting perpendicular to the means for grounding and means for transmitting wherein the means for shorting connects an edge of the means for grounding to an edge of the means for transmitting; and a feed plate wherein the feed plate has a vertex shape with the top two edges of the vertex connected to the patch plate and the bottom intersection edge of the vertex connected to a feed line that passes through an aperture in the means for grounding.

9. The patch antenna of claim 8, wherein the means for transmitting, means for shorting, and means for grounding are made of the same metallic material.

10. The patch antenna of claim 8, wherein a dielectric material comprising a lightweight foam material having a high dielectric constant is sandwiched between the means for grounding and means for transmitting.

11. The patch antenna of claim 8, wherein the feed plate is made by bending and stretching two or more tab portions of the means for transmitting towards the means for grounding to form a vertex and wherein the feed line connects at the bottom intersection edge of the vertex and the means for transmitting connects at the top two edges of the vertex.

12. The patch antenna of claim 8, further comprising a coaxial cable with a ground wire and a signal wire wherein the signal wire is the feed line and the ground wire connects to the means for grounding.

13. The patch antenna of claim 8, wherein the means for shorting and the means for transmitting are made by bending the means for grounding to about ninety degrees at a first location and bending the means for grounding to about another ninety degrees at a second location wherein the means for shorting comprises a first portion located between the first location and the second location and the means for transmitting comprises a second portion located after the second location.

14. A patch antenna comprising:

a ground plate having a bottom surface and a top surface;

a patch plate having a bottom surface and a top surface;

a shorting wall wherein the shorting wall and patch plate are made by folding the ground plate onto itself while leaving a space between the patch plate and ground plate so that the bottom surface of the patch plate is facing the top surface of the ground plate;

a feed plate wherein the feed plate is made by bending two tab portions of the patch plate toward the ground plate; and a feed line that passes through an aperture in the ground plate and connects to the ends of the two tab portions.

15. The patch antenna of claim 14, wherein the patch plate, shorting wall, and ground plate are made of the same metallic material.

16. The patch antenna of claim 14, wherein a dielectric material comprising a lightweight foam material having a high dielectric constant fills the space between the ground plate and patch plate.

17. The patch antenna of claim 14, wherein the feed plate is in a shape of a V.

18. A method of propagating electromagnetic waves, comprising:

supplying a feed signal through a single feed line;

distributing the feed signal through the single feed line substantially to at least two locations on a periphery of a patch plate;

grounding the patch plate with a shorting wall connecting the patch plate to a grounding plate; and causing electromagnetic waves to propagate from the patch plate.

19. A patch antenna, comprising:

a ground plate having an aperture;

a patch plate at least substantially parallel to the ground plate;

a shorting wall wherein the shorting wall connects an edge of the ground plate to an edge of the patch plate; and a feed line wherein the feed line passes through the aperture in the ground plate and connects to at least two locations on the patch plate, wherein two or more tab portions of the patch plate are bent toward the ground plate, and wherein the feed line passes through the aperture in the ground plate and connects to the ends of the two or more tab portions whereby the two or more tab portions are the at least two locations on the patch plate.

* * * * *

UNITED STATES PATENT AND TRADEMARK OFFICE

CERTIFICATE OF CORRECTION

PATENT NO. : 7,102,573 B2
APPLICATION NO. : 10/756,006
DATED : September 5, 2006
INVENTOR(S) : Morrow et al.

It is certified that error appears in the above-identified patent and that said Letters Patent is hereby corrected as shown below:

Col. 6, Claim 1, Lines 62 - 64, "a feed line wherein the feed line passes through the aperature in the ground plate and connects substantially to the periphery of the patch plate", should read -- a feed plate wherein the feed plate has a vertex shape with the top two edges of the vertex connected to the patch plate and the bottom intersection edge of the vertex connected to a feed line that passes through the aperature in the grounding plate. --

Col. 7, Claim 4, Lines 6 – 10, after "plate" (second occurrence), delete ", and wherein the feed line passes through the aperature in the ground plate and connects to the ends of the two or more tab portions whereby the two or more tab portions are the at least two locations on the patch plate" and insert -- to form the vertex shape of the feed plate. --

Col. 8, Claim 18, Lines 29 – 39, should read -- The patch antenna of claim 13, further comprising a coaxial cable with a ground wire and a signal wire wherein the signal wire is the feed line and the ground wire connects to the ground plate. --

Signed and Sealed this

Second Day of January, 2007

JON W. DUDAS
*Director of the United States Patent and Trademark Office*